US006368090B1

(12) United States Patent
Kim

(10) Patent No.: US 6,368,090 B1
(45) Date of Patent: Apr. 9, 2002

(54) AUTOMOTIVE VANE PUMP FOR GENERATING ANTI-CENTRIFUGAL FORCE

(75) Inventor: Jae-Chul Kim, Seoul (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 09/752,579

(22) Filed: Dec. 27, 2000

(30) Foreign Application Priority Data

Sep. 5, 2000 (KR) ..... 2000-52409

(51) Int. Cl.[7] ..... F04C 2/344; F04C 15/04
(52) U.S. Cl. ..... 418/151
(58) Field of Search ..... 418/151

(56) References Cited

U.S. PATENT DOCUMENTS 1,538,075 A * 5/1925 Wingquist ..... 418/151
2,526,621 A * 10/1950 Leibing ..... 418/151
3,589,842 A * 6/1971 Timperley ..... 418/151

* cited by examiner

*Primary Examiner*—John J. Vrablik

(74) *Attorney, Agent, or Firm*—Christie, Parker & Hale, LLP

(57) ABSTRACT

An automotive vane pump for generating anti-centrifugal force, and more particularly to an automotive vane pump for generating anti-centrifugal force adapted to maintain constant discharge pressure and discharge amount regardless of rotating speed to prevent power loss and to improve durability via stable operation, the pump comprising: a stator housing a rotor radiately equipped with a plurality of blades variably withdrawn according to the size of centrifugal force generated by being rotated and coupled to a shaft, received in a housing having inlet/outlet structure for operation oil, in coupling with a pulley driven by an engine; a cover coupled to the housing mounted with the stator for sealing up the housing; and centrifugal force generating means corresponding to each said blade mounted at the rotor and operatively connected to each said blade for generating centrifugal force in order to pull the corresponding blade into the rotor against radial withdrawal of the blade, where each centrifugal force generating means further comprises: a resilient member constituting a spring radiately formed at the rotor, equipped at a slot accepting the corresponding blade and compressed by movement of the corresopnding blade; and a ball pendulum exposed to a centrally-opened communicating groove through a connecting groove connected to the slot where the corresponding blade is accommodated.

5 Claims, 3 Drawing Sheets

AUTOMOTIVE VANE PUMP FOR GENERATING ANTI-CENTRIFUGAL FORCE

BACKGROUND OF THE INVENTION

1. Field of the Invention

The present invention relates to an automotive vane pump for generating anti-centrifugal force, and more particularly to an automotive vane pump for generating anti-centrifugal force adapted to maintain constant discharge pressure and discharge amount regardless of rotating speed to prevent power loss and to improve durability via stable operation.

2. Description of the Prior Art

In general, automotive devices such as power steering apparatus and the like operated via oil pressure, utilize vane pumps driven by engine output for generation of oil pressure. As illustrated in FIG. 1, the automotive device includes a stator 4 having a rotor 5 radiately equipped with a plurality of blades 6 rotated by a shaft 2 coupled to a pulley 1 driven by an engine and varied by centrifugal force, and a housing 3 where the stator 4 is received via a cover 7.

When the pulley 1 rotating with the engine and the shaft 2 is rotated, the rotor 5 in the housing 3 is rotated at the same time, and the blades 6 radiately appearing and disappearing according to rotary centrifugal force of the rotor 5 make sliding contact along the rotor-receiving stator 4 and variably increase volume at a suction region (not shown), such that a vacuum suction force is generated at the suction region to suck operation oil from and oil tank (not shown), generating oil pressure. In other words, the operation oil infused into the stator 4 is pushed into and compressed in a narrow area of the stator 4 to generate the oil pressure.

However, there is a problem. The operation oil being infused into the stator 4 via the blades 6 radiately protruded according to the amount of centrifugal force from the rotor 5 is compressed. The compressed amount and the pressure of the vane pump rotating at a high speed are increased to simultaneously increase the centrifugal force of the blades, such that friction with the stator 4 is also increased to generate abrasion at the blades 6 and stator 4, thereby greatly increasing noise.

There is another problem in that the mutually-abraded blades 6 and the stator 4 also create vibration, This results In generation of resonance to peripheral devices such as the engine and the like. This shortens the life of the automobile and decreases the quality thereof.

SUMMARY OF THE INVENTION

The present invention is disclosed to solve the aforementioned problems and it is an object of the present invention to provide an automotive vane pump for generating anti-centrifugal force adapted to react against the centrifugal force working on blades when a rotor is rotated to thereby restrict radial protrusion of the blades according to increased turning effect such that a constant gap can be maintained at all times without direct contact with stator.

In accordance with the object of the present invention, there is provided an automotive vane pump for generating anti-centrifugal force, the pump comprising:

a stator housing a rotor radiately equipped with a plurality of blades variably withdrawn according to the size of centrifugal force generated by being rotated and coupled to a shaft received in a housing having inlet/outlet structure for operation oil, in coupling with a pulley driven by an engine;

a cover coupled to the housing mounted with the stator for sealing up the housing; and centrifugal force generating means corresponding to each said blade mounted at the rotor and operatively connected to the corresponding blade for generating centrifugal force in order to pull the corresponding blade into the rotor against radial withdrawal of the corresponding blade where each centrifugal force generating means further comprises:

a resilient member constituting a spring radiately formed in the rotor, equipped at a slot accepting the corresponding blade and compressed by movement of the corresponding blade; and a ball pendulum exposed to a centrally-opened communicating groove through a connecting groove connected to the slot where the corresponding blade is accommodated.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Now, preferred embodiments of the present invention will be described in detail with reference to the accompanying drawings.

Figure 1:
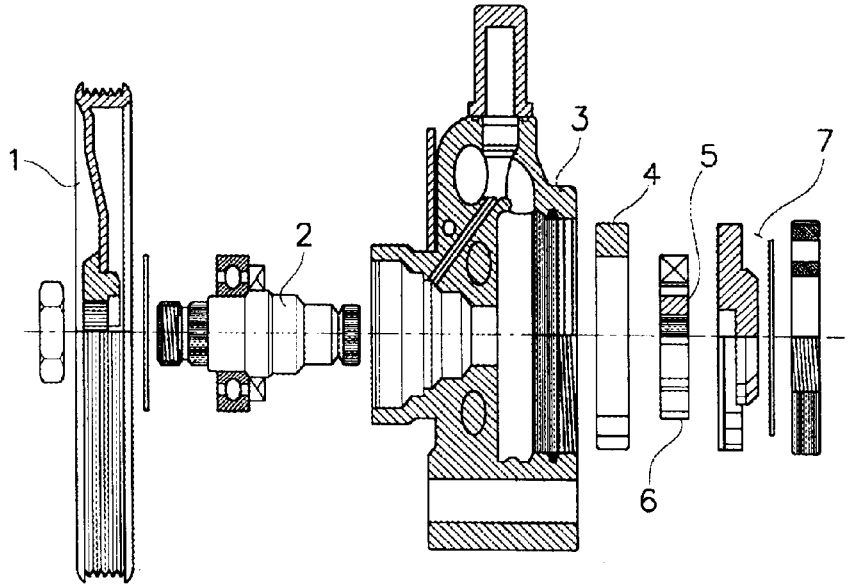
FIG. 1 (prior art)
FIG. 1 is an exploded constitutional drawing of a vane pump according to the prior art.
Figure 2:
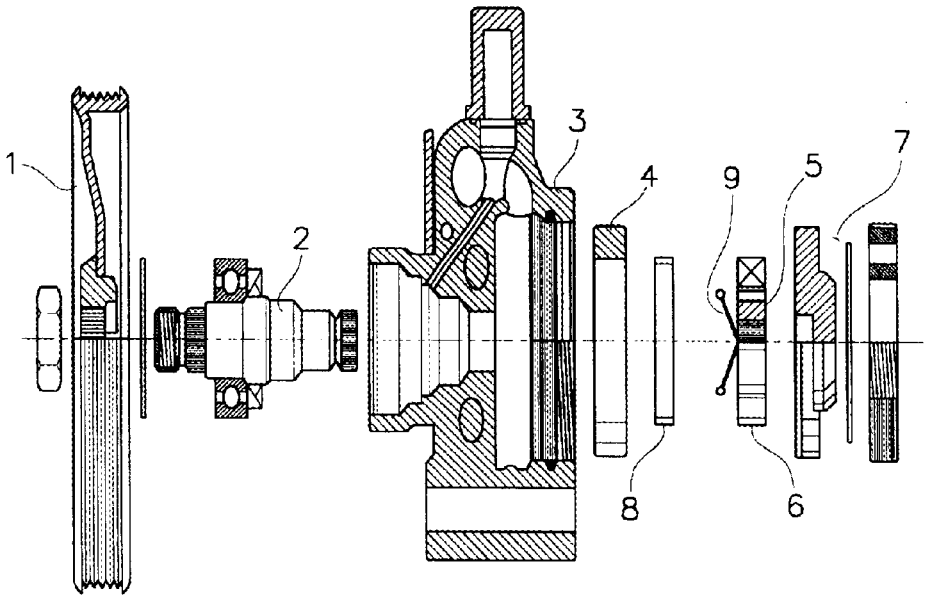
FIG. 2 is an exploded constitutional drawing of an automotive vane pump for generating anti-centrifugal force according to the present invention.

FIG. 2 is an exploded constitutional drawing of an automotive vane pump for generating anti-centrifugal force according to the present invention, where the vane pump includes a shaft 2 coupled to a pulley 1 driven by an engine, a stator 4 mounted therein with a rotor 5 radiately equipped with a plurality of blades variably withdrawn according to the size of centrifugal force generated in rotation with the coupled shaft 2, centrifugal generating means 9 mounted at the rotor 5 accommodated in the stator 4 for generating centrifugal force in order to pull the blades 6 into the rotor 4 against radial withdrawal of the blades 6, a housing 3 for accepting the stator 4, shaft 2 and the like and having an inlet/outlet structure of operation oil, and a cover 7 for sealing up the housing 3.

Figure 3:
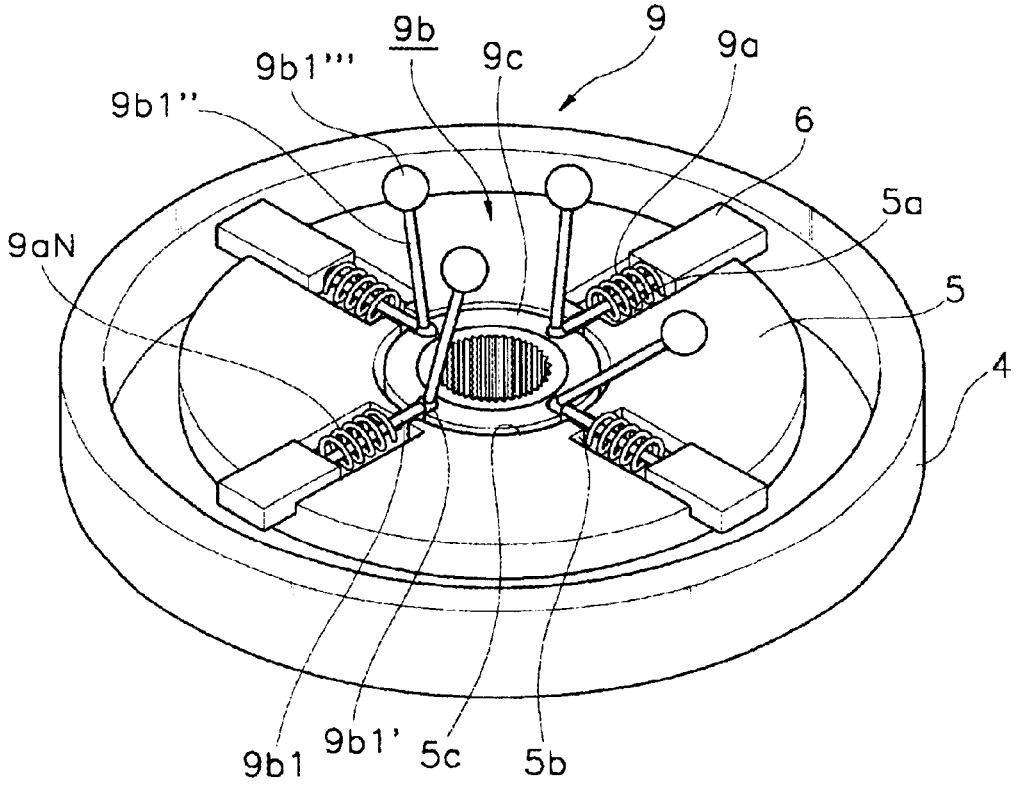
FIG. 3 is a perspective view for illustrating counter centrifugal force generating means for forcibly reducing the size of centrifugal force against centrifugal force generated from variable means.

At this location, the centrifugal generating means 9, as illustrated in FIG. 3, is formed with a resilient member 9*a* constituting a spring radiately formed at the rotor 5 in a slot 5*a* accepting the blades 6 and compressed by movement of the blades 6, and a ball pendulum 9*b* exposed to a centrally-opened communicating groove 5*c* through a connecting groove 5*b* connected to the slot 5*a* where the blades 6 are accommodated.

In other words, the ball pendulum 9*b* includes a first link 9*b*1 fixed to one end of a blade 6, a second link 9*b*1" inserted into the communicating groove 5*c* for coupling the first and second link 9*b*1 and 9*b*1" which are formed at the plurality of blades 6 radiately provided via a connecting ring 9*c* inserted into the communicating groove 5*c* and vertically moving according to centrifugal force.

Unexplained reference numeral 8 is a case equipped at the rotor 5 for encompassing the ball pendulum 9*b*.

Now, operational procedure will be described according to the present invention.

The vane pump according to the present invention, is formed such that the blades 6 radiately appear and disappear according to the centrifugal force generated by the rotor 5 rotating by way of a turning effect of the pulley 1 received via the shaft 2 along with the engine to generate vacuum suction force for sucking operation oil from an oil tank in the stator 4, and to compress the infused operation oil for generation of oil pressure.

At this time, the turning effect of the rotor 5 working to allow the blades 6 to radiately appear and disappear rotates the ball pendulum 9*b* at the centrifugal force generating means 9 to thereby introduce the blades 6 into the rotor 5 according to the size of the centrifugal force, where the rotating speed of the rotor 5 is explained in detail.

First of all, when the rotor 5 is rotated at a low speed, the centrifugal force generated by rotation of the rotor 5 pushes the blades outside of the rotor 5 to a maximum degree, where the ball pendulum 9*b* at the centrifugal force generating means 9 rotating with the rotor 5 is also influenced by the centrifugal force.

However, a radius from the center of the rotor 5 to the ball 9*b*1" of the ball pendulum 9*b* is smaller than the radius of up to one end of the blade 6 such that a relatively smaller centrifugal force is created and the spring resilience of the resilient member 9*a* provided at the slot 5*a* of the rotor 5 act to push out the blades 6, such that the centrifugal force created from the ball pendulum 9*b* cannot pull the blades 6 toward the rotor 5 whereby the blades 6 are maximally pulled from the rotor 5 to make sliding contact with the stator 4, thereby generating a large compression force and oil pressure at the same time.

Successively, when the rotor 5 is accelerated in rotation thereof from a low speed to an intermediate speed, the centrifugal force generated by the rotating rotor 5 tries to push out the blades with much greater force but the blades 6 are made to be pulled inside of the rotor 5 because the centrifugal force of the ball pendulum 9*b* mounted with the ball 9*b*1" having a predetermined weight becomes relatively bigger than the centrifugal force of the rotating rotor 5.

In other words, the centrifugal force of the ball pendulum 9*b* resists the centrifugal force of the blades 6 which try to go out, and instead is pulled in to overcome repulsive force of the spring which is the resilient member 9*a*, and compressed to pull in the blades.

Successively, the blades 6 are rotated with a slight gap from an inner surface of the stator 4, that is, rotated without sliding contact with the inner surface of the stator 4 to thereby create less compression force than the compression made during the low speed of rotation. However, the kind of compression loss is not that large compared with compression increase according to increased speed, such that no decrease of oil pressure of operation oil occurs.

Furthermore, when the rotor 5 is increased in speed thereof from the intermediate lever to a high level, the centrifugal force generated by the rotating rotor 5 makes the centrifugal force of the ball pendulum 9*b* much greater to thereby pull in the blades 6 deeper into the rotor 5.

Figure 5:
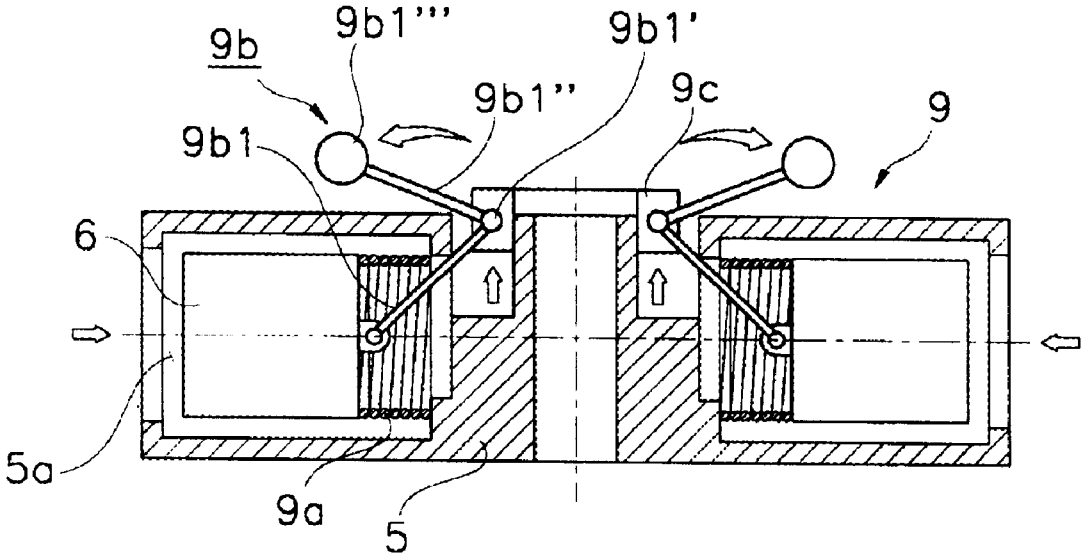
FIG. 5 is an operational constitutional drawing for illustrating counter centrifugal force generating means for forcibly reducing the size of centrifugal force generated from variable means.

In other words, as illustrated in FIG. 5, the centrifugal force of the ball pendulum 9*b* resists the centrifugal force of the blades 6 trying to pull out and pulls in the blades 6, and compresses the resilient member 9*a* of spring to pull in the blades 6. At this time, the connecting ring 9*c* of the ball pendulum 9*b* is raised with the hinge 9*b*1" coupling the first and second links 9*b*1 and 9*b*' raised by the ball (9*b*1" laid down toward surface of the rotor 5.

Successively, the blades 6 are rotated with a relatively larger gap from the inner surface of the stator 4 compared with the rotor 5 at the intermediate speed of lower without making sliding contact. However, the blades 6 are rotated at a speed relatively higher than the speed of low or intermediate level such that a greater compression force is generated to remarkably increase oil pressure of the operation oil.

In comparison with the rotor 5 rotating at a lower speed with sliding contact with the inner surface of the stator 4, the blades are rotated with a slight gap from the inner surface of the stator 4 at the intermediate and high speed of rotation, thereby generating no noise and friction.

Figure 4:
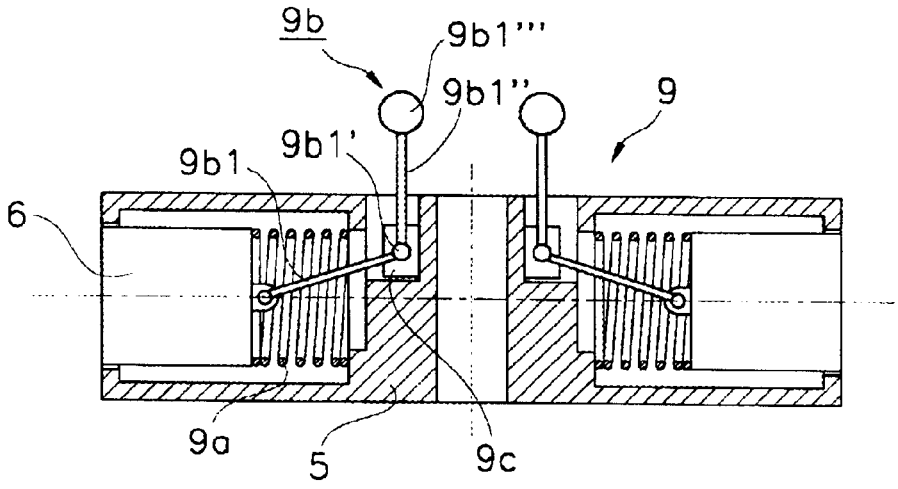
FIG. 4 is a partial sectional view for illustrating counter centrifugal force generating means for forcibly reducing the size of centrifugal force against centrifugal force generated from variable means.

Meanwhile, when the rotor 5 is reduced in rotation thereof from high speed to intermediate speed, and again from intermediate speed to low speed, the centrifugal force acting on the ball pendulum 9*b* at the centrifugal force generating means 9 is decreased, whereby, the spring which is the resilient member 9*a* is restored to push the blades 6 to the outside, such that the connecting ring 9*c* is lowered along with the hinge 9*b*1" coupling the first and the second link 9*b*1 and 9*b*1" which moves downward, thereby making a form as shown in FIG. 4.

As apparent from the foregoing, there is an advantage in the automotive vane pump for generating anti-centrifugal force thus described according to the present invention in that centrifugal force is generated to reversely react to pull the blades toward the rotor by way of the rotor allowing the blades to radiately appear and disappear via the centrifugal force, thus forming a gap between the blades and the stator by way of rotor increasing in rotational speed to prevent friction and noise, such that constant discharge pressure and discharge volume are maintained regardless of rotational speed to thereby avoid power loss and improve durability by way of stable operation.

What is claimed is:

1. An automotive vane pump for generating anti-centrifugal force, the pump comprising:

a stator housing a rotor radiately equipped with a plurality of blades variably withdrawn according to size of centrifugal force generated by being rotated and coupled to a shaft received in a housing having inlet/outlet structure for operation oil in coupling with a pulley driven by an engine;

a cover coupled to the housing mounted with the stator for sealing up the housing; and centrifugal force generating means corresponding to each said blade mounted at the rotor and operatively connected to the corresponding blade for generating centrifugal force in order to pull the corresponding blade into the rotor against radial withdrawal of the corresponding blade, where each centrifugal force generating means further comprises:

a resilient member constituting a spring radiately formed in the rotor, equipped at a slot accepting the corresponding blade and compressed by movement of the corresponding blade; and a ball pendulum exposed to a centrally-opened communicating groove through a connecting groove connected to the slot where the corresponding blade is accommodated.

2. The pump as defined in claim 1 wherein each resilient member is a spring having a resilient force.

3. The pump as defined in claim 1 comprising a case mounted at the rotor for encompassing each ball pendulum.

4. The pump as defined in claim 1 where each ball pendulum comprises:

a first link fixed to one end of the corresponding blade;

a second link coupled to the first link via a hinge; and a ball coupled to one end of the second link and having a predetermined weight.

5. The pump as defined in claim 4, therein the hinge is coupled to a connecting ring vertically moving according to centrifugal force and being inserted into a communicating groove of the rotor.

* * * * *

UNITED STATES PATENT AND TRADEMARK OFFICE

CERTIFICATE OF CORRECTION

PATENT NO. : 6,368,090 B1
DATED : April 9, 2002
INVENTOR(S) : Jae-Chul Kim

It is certified that error appears in the above-identified patent and that said Letters Patent is hereby corrected as shown below:

Column 6,
Line 3, replace “therein” with -- wherein --

Signed and Sealed this

Second Day of September, 2003

JAMES E. ROGAN
*Director of the United States Patent and Trademark Office*